United States Patent [19]

Gilbertson

[11] 4,446,703

[45] May 8, 1984

[54] AIR CONDITIONING SYSTEM AND METHOD

[76] Inventor: Thomas A. Gilbertson, 216 Sandringham, N., Moraga, Calif. 94566

[21] Appl. No.: 381,862

[22] Filed: May 25, 1982

[51] Int. Cl.[3] ..... F25B 41/00

[52] U.S. Cl. ..... 62/113; 62/183; 62/506

[58] Field of Search ..... 62/183, 506, 113

[56] References Cited

U.S. PATENT DOCUMENTS

| | | | |
|---|---|---|---|
| 2,490,983 | 12/1949 | Smith et al. | 62/506 X |
| 2,715,320 | 8/1955 | Wright | 62/183 X |
| 4,067,205 | 1/1978 | Mayhue | 62/506 X |
| 4,313,310 | 2/1982 | Kobayashi et al. | 62/183 X |

*Primary Examiner*—Lloyd L. King
*Attorney, Agent, or Firm*—Flehr, Hohbach, Test, Albritton & Herbert

[57] ABSTRACT

Air conditioning systems and methods for use in multi-unit buildings wherein an air conditioning system is provided with an air handling unit which includes a water cooled first heat absorbing means, a mechanical refrigerant cooled second heat absorbing means, and means for circulating air successively through the first and second heat absorbing means. Means is provided for circulating cooling water successively through a first heat absorbing means and a refrigerant condensing heat exchanger in series relation with a flow rate through at least the first heat absorbing means substantially independent of the operating condition of the refrigerant compressor and the refrigerant condensing heat exchanger.

11 Claims, 5 Drawing Figures

AIR CONDITIONING SYSTEM AND METHOD

This invention relates to air conditioning systems and methods and, more specifically, to air conditioning systems and methods for use in multi-unit buildings.

Because of increasing costs and scareness of energy resources, it is highly desirable that air conditioning systems for commericial and residential multi-unit buildings operate with as much energy utilization efficiency as possible. Commercial buildings require refrigeration of the air inside the building during at least part of the day, in both summer and winter periods, even in climates where winter temperatures are relatively low. This is due both to solar insolation on the building and the internal heat load generated by lighting, equipment and personnel.

Basically there are two approaches that can be taken to saving energy in refrigerating air in multi-unit buildings. One approach involves use of the water side economizer concept and the other utilizes the air side economizer concept. The air side economizer concept involves utilizing the free cooling effect of cooler ambient outside air to minimize mechanical refrigeration cooling otherwise required. The water side economizer approach utilizes cooled water from a cooling tower or other cool water source (e.g. cool ground water from a spring, well or stream) to provide cooling of the air communicated past a water coil in individual or central air handling units.

The air side economizer concept may be implemented in a central air handling and refrigeration unit for the entire building or on a distributed basis by using separate outside air inlet ducts and dampering arrangements for each of a multiple of air handling units throughout the building. The savings in energy costs achieved by use of cooler outside air in air economizer systems is dissipated to some extent by the costs of running large fan units to move the air. Moreover, the air side economizer approach inherently involves expensive ducting and automatically controlled damper arrangements in order to achieve automated operation of the system. This results in large initial installation costs and substantial maintenance costs and difficulties due to the large number of electro-mechanical components involved in the controlled air damper units. Furthermore, because of the difficulty involved in providing accurate control over entry of outside air, such systems bring in a substantial amount of outside air (e.g. to meet fresh air change requirements) even when a low degree of cooling is required and then heat that cooled outside air to the appropriate temperature for the internal requirements of the building. This places additional energy demand on utilization of the system.

The prior art has taken a number of different approaches to implementing a water side economizer concept in air conditioning systems for multi-unit buildings. One approach taken in the art is to supply cooled water from a cooling tower or other cool water source directly to a refrigerant condensing heat exchangers to condense refrigerant from evaporators in mechanical refrigeration types of air handling units. This is a slightly more energy efficient method of condensing the refrigerant than using fan forced air cooling. At most this represents a minor beneficial use of a narrow aspect of the water side economizer concept.

In another water side economizer approach, cooled water is supplied to a water coil in each individual air handling unit to provide pre-cooling of the air passing therethrough with water exiting the water coil taken directly back to the cooling tower or otherwise disposed of. In such a system less mechanical refrigeration type of cooling is required and the cooled water passing through the water coil will handle the demand for refrigeration of the air during substantial portions of the cooling cycle, especially on cool or cold days.

Another approach to implementation of the water side economizer concept involves using only a water coil in each of a plurality of individual air handling units within the building. A central mechanical refrigeration system is used to provide additional cooling of the water supplied to the individual water coils when the cooling water from the cooling tower or other cool water source can not handle the heat load. This type of central water side economizer system provides good energy efficiency when the entire building is occupied and supplemental cooling is generally required by each unit within the building.

However, it is much less efficient when the central chill water system must turn on to service one floor which is not getting enough cooling from the cool water itself to handle the heat localized load.

The prior art has also proposed a type of air conditioning system in which a water coil is placed in individual air handling units along with one or more refrigerant evaporators and cooling water is passed in series through the water coil and a refrigerant condensing heat exchanger when mechanical refrigerant cooling of the air passing through the air handling unit is required. Such a system is disclosed, for example, in Philipp U.S. Pat. No. 2,146,483. However, in this system the cool water is supplied to the water coil in individual air handling units only when the mechanical refrigeration system is also operating since the flow of cooled water is regulated by a valve which opens only when cooling water is required for condensing the evaporated refrigerant flowing through the refrigerant condensing heat exchanger. Accordingly, the flow of water through the water coil to provide precooling of the air passing through the individual air handling units has a flow rate which is dependent on the operating condition of the mechanical refrigeration system associated with the air handling unit. In this approach, cooling by the water coil is not achieved independent of mechanically refrigeration. This approach contributes at best a minor improvement in energy efficiency and is not a major implementation of the water side economizer concept.

It is the principal object of this invention to provide an improved air conditioning system and method utilizing the water side economizer concept.

It is another object of this invention to provide an air conditioning system and method for multi-unit buildings having high energy efficiency and low installation cost and maintenance.

In accordance with one broad aspect of this invention, an air conditioning system is provided with an air handling unit which includes a water cooled first heat absorbing means, a mechanical refrigerant cooled second heat absorbing means, and means for circulating air successively through the first and second heat absorbing means. A refrigerant compressor and refrigerant condensing heat exchanger are operatively associated with the second heat absorbing means. Means is provided for circulating cooling water successively through the first heat absorbing means and the refrigerant condensing heat exchanger in series relation with a flow rate through at least the first heat absorbing means substantially independent of the operating condition of the refrigerant compressor and the refrigerant condensing heat exchanger.

When the invention is utilized in a multi-unit building where each of the building units include at least one air handling unit, the second heat absorbing means in each air handling unit may comprise at least one refrigerant evaporator coupled to a refrigerant compressor and a refrigerant condensing heat exchanger. A first control means is provided for controlling the cooling capacity of the cooling water provided to the first heat absorbing means substantially independent of the operation of the refrigerant compressor and the refrigerant evaporator to provide primary cooling of air flowing through each of the air handling units. Second control means are individually associated with each of the building units for separately controlling the operation of the refrigerant compressors and the refrigerant condensing heat exchangers associated with air handling units within that building unit to provide supplemental cooling of the air flowing through each of the air handling units as required.

If desired, individual cooling water bypass units may be provided for the first heat absorbing means in each air handling unit and for the refrigerant condensing exchanger associated with each refrigerant compressor and refrigerant evaporator to separately control the flow rate of cooling water through these components. Furthermore, fresh air may be provided to each of the individual building units by utilizing a central fresh air intake, a common air distribution system for coupling the fresh air intake to each of the building units and a common air pumping means for pumping the fresh air from the intake through the air distribution means.

Broadly stated, another aspect of this invention involves a method of conditioning air which comprises circulating air in heat exchange relation with both a water cooled first heat absorbing means and a mechanical refrigerant cooled second heat absorbing means. The method further involves circulating cooling water through the first heat absorbing means substantially independent of the operating condition of the second heat absorbing means to cool the circulating air. In addition, the method involves circulating mechanically refrigerated cooling fluid through the second heat absorbing means only when cooling provided by the first heat absorbing means is inadequate for the heat load imposed by the air. Finally, at least a portion of the cooling water from the first heat absorbing means is utilized to condense vaporized refrigerant associated with producing the mechanically refrigerated cooling fluid.

One aspect of the method of this invention as applied to conditioning air in a multi-unit building involves disposing at least one air handling unit in each building unit with at least a water coil and one refrigerant evaporator disposed in series in the air handling unit. Air is circulated in heat exchange relation with the water coil and the refrigerant evaporator in each of the air handling units. Cooled water is supplied to the water coil in each air handling unit to provide a primary cooling of circulating air. Condensed refrigerant is supplied to the refrigerant evaporator in each air handling unit when demand for refrigeration of air passing through that unit exceeds the cooling capacity of the cooled water traversing the water coil. Vaporized refrigerant from the refrigerant evaporator is withdrawn and at least a portion of the cooling water exiting the water coil in each air handling unit is utilized to at least partially condense the vaporized refrigerant. The condensed refrigerant is returned to the refrigerant evaporator so long as the additional refrigeration demand for the associated air handling unit persists.

The air conditioning system and method in accordance with this invention has numerous advantages over the prior art approaches to implementing the water side economizer concept described above. It is believed that the system and method of this invention optimizes the energy savings achievable with the water side economizer concept. This optimization is achieved by utilizing the cooling effect from the cooled water passing through the water coil in each air handling unit independent of the demand for supplemental cooling to be provided by other mechanical refrigeration equipment associated with air handling units in the building but also using the cooling water to assist in condensing evaporated refrigerant during operation of mechanical refrigerant equipment. In this manner, the water coil in each air handling unit can handle the heat load by itself during at least a portion of the time period when cooling of the circulating air is required. At the same time the cooled water exiting the water coil is utilized to condense evaporated refrigerant and thus reduces energy consumption associated with this function. When carefully implemented, the system and method of this invention can be carried out in practice without requiring control over the flow of cooled water through the water coil or through the refrigerant condensing heat exchanger. This greatly simplifies the overall system and substantially reduces initial installation costs and minimizes the use of components which may require service or maintenance to maintain proper system or operation.

However, the major advantages of this invention are also achieved in systems in which simplified control of the water passing through one or both of the water coil and refrigerant condensing heat exchanger are provided by utilizing a bypass arrangement with a control valve which controls the amount of cooled water which passes through one or both components.

Other and more specific objects, features, and advantages of this invention will be apparent from a consideration of the detailed description given below in conjunction with the accompanying drawings.

Figure 1:
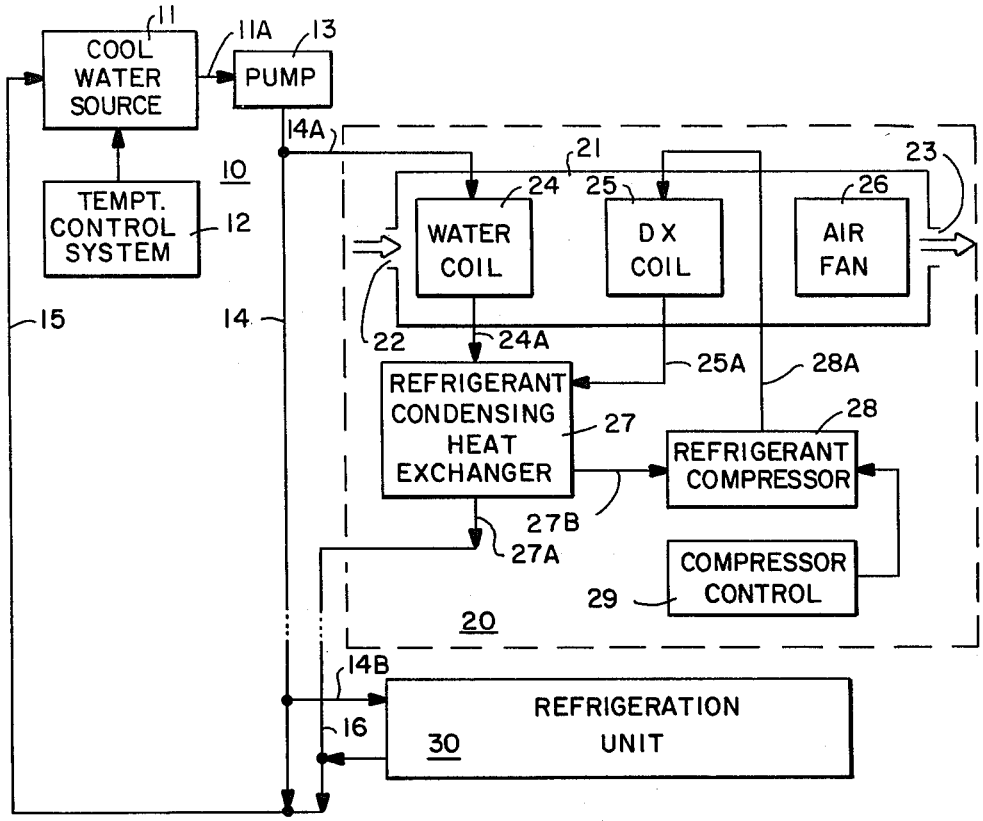
FIG. 1 is a block schematic diagram of one embodiment of an air conditioning system in accordance with this invention.

Referring now to FIG. 1, an air conditioning system in accordance with this invention includes a cooling water source arrangement 10 and at least one refrigeration unit 20. In a multi-unit building additional refrigeration units such as unit 30 would also be provided. Cool water source arrangement 10 includes a cool water source 11 which may, for example, be a cooling tower, a cool ground water source, or some other source of cooling water. A pump 13 is provided for pumping the cooled water from outlet llA of the cool water source 10 to a main cool water pipe 14. A return water pipe 15 may be utilized for returning water to the cool water source 11 in the event a water recirculating cooling tower system is utilized. A temperature control system 12 is preferably included to provide central control over the temperature of the cool water supplied at outlet 11A and thus the temperature of water in the main cool water pipe 14. If a cooling tower is utilized as a cool water source, any of the typical approaches to controlling the temperature of the water from the cooling tower, such as fans, dampers and the like, may be utilized.

Refrigeration unit 20 includes an air handling unit 21 having an air inlet 22 and an air outlet 23. Air handling unit 21 includes a water coil 24 serving as a water cooled first heat absorbing means. Also provided within air handling unit 21 is a DX coil serving as a mechanical refrigerant cooled second heat absorbing means. Air fan 26 is provided within air handling unit 21 to serve as a means for circulating air successively through water coil 24 and DX coil 25. A refrigerant compressor 28 supplies partially liquified, compressed refrigerant via a refrigerant supply line 27B to refrigerant condensing heat exchanger 27. Outlet line 25A from heat exchanger 27 supplies condensed refrigerant to DX coil 25. The evaporated refrigerant is then supplied via line 28A to refrigerant compressor 28. A compressor control unit 29 which may comprise any standard control arrangement for turning refrigerant compressor 28 on and off is provided in air handling unit 20.

Cooled water is supplied to water coil 24 from the main cool water pipe 14 via a supply pipe 14A. The cool water exiting water coil 24 through outlet 24A is supplied to refrigerant condensing heat exchanger 27 where it cools and condenses any refrigerant flowing through the refrigerant condensing heat exchanger 27. The cool water is then supplied via the outlet 27A to a common cool water return pipe 16. Alternatively the cool water from the outlet 27A may be supplied to any type of water drain in a system where the cool water is not recirculated to the cooling tower.

Refrigeration unit 30 contains the same components as the refrigeration unit 20. Each individual air handling and refrigeration unit within a multi-unit building contains essentially the same components. It should, however, be understood that within a single unit of a multi-unit building a number of air handling units supplied by a common refrigerant compressor and refrigerant condensing heat exchanger may be provided if individual temperature control within individual zones in each building unit is not required.

It should also be understood that although a single water coil 24 and single DX coil 25 are shown schematically in FIG. 1, multiple water coils and refrigerant evaporation coils may be provided in each individual air handling unit if desired. It should also be understood that, in such systems individual control valves may be provided for controlling the flow of cooling water or refrigerant as the case may be to the individual ones of multiple water coils and/or evaporator coils in each unit. Accordingly, it should be understood that the overall system may be either simple or complex depending on engineering design implementation.

The operation of the system shown in FIG. 1 involves continually supplying cooling water to the water coils 24 in each refrigeration unit during operating periods when cooling is called for by the overall multi-unit building. The degree of cooling provided by the water coil in each air handling unit may be controlled by the temperature control system 12. If desired the sizes of individual water coils and/or the flow rate of cooling water through various water coils may be controlled to distribute non-uniformly the cooling capacity of the cooling water. The cooling effect of the cooled water passing through water coil is achieved independently of any operation of the mechanical refrigeration circuit in each refrigeration unit. Air fan 26 will usually be operated continuously to circulate air over the water coil 24. Under low heat load circumstances, this cooling of the air passing through the air handling unit 21 is sufficient to condition the air in the associated building unit without requiring any mechanical refrigeration.

When the heat load in the building unit associated with air handling and refrigeration unit 20 becomes too great for the cooling capacity of the water coil 24 by itself, refrigerant compressor 28 is turned on by compressor control 29. At this time, the water coil 24 continues to provide some cooling of the air passing through the air handling unit 21 with additional cooling provided by passing the air over the refrigerant cooled DX coil 25. The evaporated refrigerant is condensed in refrigerant condensing heat exchanger 27. This condensation of refrigerant is assisted by cool water from water coil 24 passing through the condensing heat exchanger 27. Under these conditions then the cool water supplied through water coil 24 serves a dual purpose of initial, partial cooling of the air flowing through air handling unit 21 and condensing the refrigerant passing through the refrigerant condensing heat exchanger 27. This provides maximum effective utilization of the cooling water both to reduce the time periods that the mechanical refrigeration unit is required to operate and also to reduce the energy required to condense the evaporated refrigerant during operation of mechanical refrigerant components.

In the embodiment shown in FIG. 1, the system is engineered so that no controls are required in the cool water circuit other than the central temperature control system controlling the outlet temperature of the cool water from the cool water source 11. In other words, in a carefully engineered system, there is no requirement for throttling the amount of water passing into the water coils in each air handling unit or for head pressure control on the water passing through the refrigerant condensing heat exchanger. Instead the system is designed so that, by simply controlling the water temperature off the cooling tower, you never provide overcooling to any individual air handling unit. Similarly, the size and capacity of the cooling tower is designed such that, even with maximum heat load on the water passing through the individual water coils and through the refrigerant condensing heat exchangers in individual units, there is never overheating of the recirculated water and thus there is always some benefit from supplying the cooling water through the water coil 24 in each unit.

Figure 2:
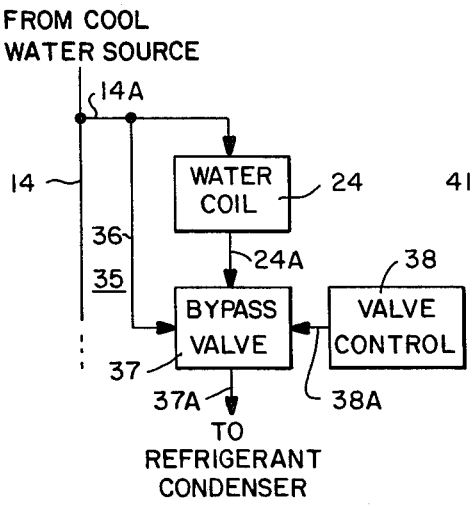
FIG. 2 is a partial block schematic diagram of an alternative embodiment of an air conditioning system in accordance with this invention.

If it is necessary in certain systems implementation of the invention to control the flow rate of water to the water coil 24, a modified system as depicted in FIG. 2 may be employed. In this modified system, a cool water bypass arrangement 35 is provided, including a cool water bypass pipe 36, a bypass valve 37 and a bypass valve control 38. Bypass valve 37 controls the relative flow rates of the cooling water from inlet pipe 14A through the water coil 24 and through the bypass pipe 36. Valve control unit 38 may utilize any type of control arrangement such as monitoring the temperature of the water flowing through the cooling water inlet pipe 14A to completely bypass water coil 24 if the water flowing through cooling water main pipe 14 is too hot. Alternatively, valve control unit 38 might monitor the air at outlet 23 of the air handling unit (FIG. 1) and operate bypass valve 37 to bypass a substantial amount of water around water coil 24 if the temperature of the cool water in the main supply pipe 14 is too low for the amount of cooling required. Any number of these various types of valve control functions may be implemented utilizing this 3-way bypass valve arrangement.

Figure 3:
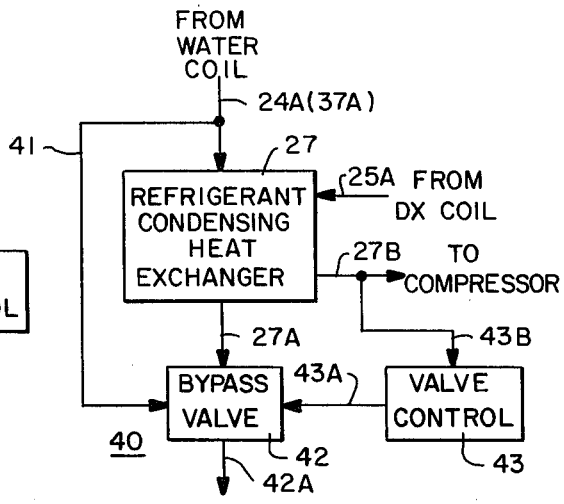
FIG. 3 is a partial block schematic diagram of another embodiment of an air conditioning system in accordance with this invention.

FIG. 3 illustrates a similar bypass arrangement for refrigerant condensing heat exchanger 27. Bypass arrangement 40 includes a bypass pipe 41, a bypass valve 42 and a bypass valve control 43. In this case, bypass valve control 43 may be utilized to provide head pressure control for the refrigerant compressor by monitoring over control line 43B the head pressure of the condensed gas leaving the refrigerant compressor. It is important to note, however, that the bypass arrangement 40 associated with refrigerant condensing heat exchanger 27 enables the flow of cool water through water coil 24 to be independent of the amount of cool water supplied through the refrigerant condensing heat exchanger 27. This maintains the independent operation of the initial, primary cooling effected by the water coil 24 in air handling unit 21 shown in FIG. 1 so that maximum affectiveness of the initial air cooling can always be achieved.

Figure 4:
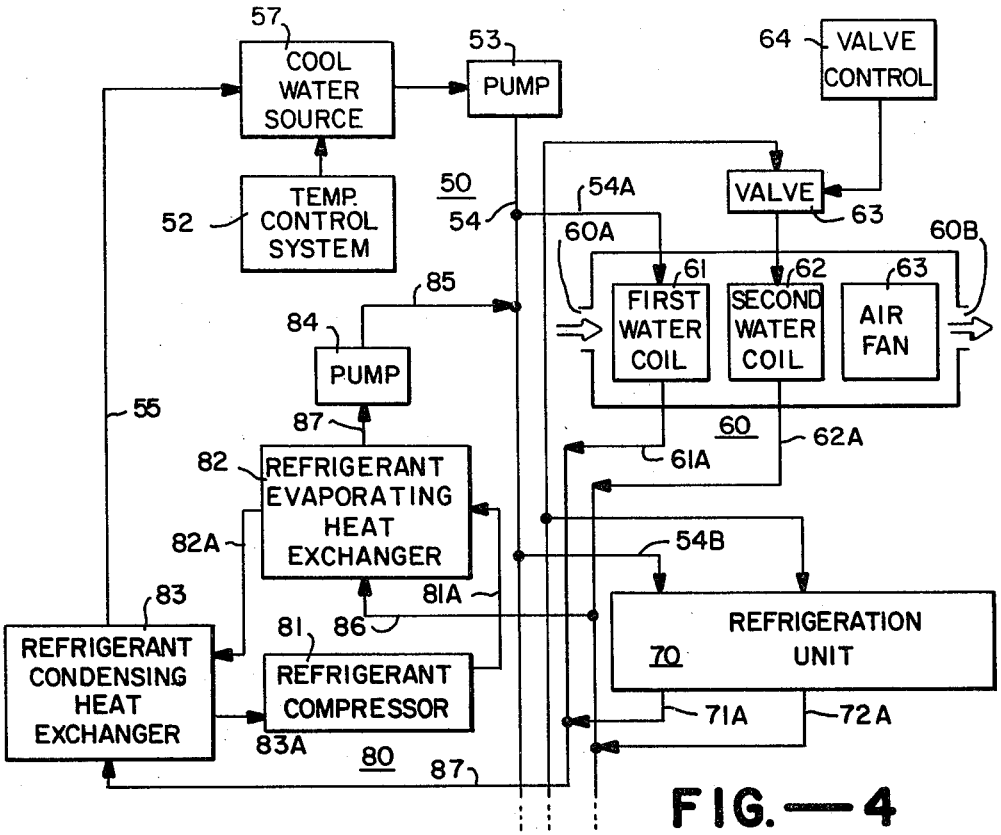
FIG. 4 is a system block schematic diagram of an alternative embodiment of an air conditioning system in accordance with this invention.

FIG. 4 illustrates that the basic principles of this invention can also be employed in an air conditioning system utilizing a central chill water plant. In the system shown in FIG. 4, cool water source arrangement 50 is employed. Cool water source arrangement 50 includes a cool water source 51, a temperature control system 52 for cool water source 51 and a pump 53 for delivering the cool water through a main cool water pipe 54 feeding water coils in each of the refrigeration units 60 and 70, for example, water coil 61 shown in air handling unit 60.

Air handling unit 60 includes both a first water coil 61 in circuit with the cool water source 51 and also a second water coil arrangement 62 in circuit with central chill water plant 80. Air handling unit 60 also includes an air fan 63 for circulating air successively over the separate water coils 61 and 62.

The central chill water plant 80 includes a refrigerant compressor 81 which supplies compressed refrigerant via line 83A to a refrigerant condensing heat exchanger and then via line 82A to a refrigerant evaporating heat exchanger 83 for cooling water pumped through the chill water circuit comprising common inlet pipe 86, common outlet pipe 87, pump 84 and a main chill water supply line 85 which supplies the individual second water coils in each of the air handling units. The return line 86 is fed by the outlets from the chill water coils in each of the air handling units, for example, outlet 62A and 72A shown in FIG. 4. The evaporated refrigerant from heat exchanger 82 is supplied via line 81A to compressor 81 and then to a refrigerant condensing heat exchanger 83 where the refrigerant is condensed utilizing cooling water from the return line 87 which, in turn, is fed by the outlet pipes from each of the first water coils within the air handling units, such as water coil 61 in air handling unit 60. The cool water exiting refrigerant condensing heat exchanger 83 may then be returned via line 55 to the cool water source 51 or, alternatively, may be supplied to a water drain.

In the system in FIG. 4, the initial cooling of air passing through the individual air handling units is provided by the individual first water coils (e.g. water coil 61) supplied with cool water from the cooling water source 51. When this cooling arrangement is inadequate for the heat load in additional cooling is provided by supplying cooled water from the main chill water system 80 through the second water coil in each air handling unit. As shown in FIG. 4, each second water coil 62 also includes an appropriate valving arrangement for controlling the supply of chilled water through the second water coil. For illustration a two way valve 65 and a valve control 64 are shown as part of refrigeration unit 60. A three-way valve and bypass pipe arrangement for each second water coil could alternatively be employed.

The alternative embodiment shown in FIG. 4 utilizes the principle of combining the cooling effect of water from the cool water source 51 though a first water coil in each individual air handling unit for initial cooling together with utilizing cool water exiting each water coil to condense refrigerant associated with a mechanical refrigeration system which is cycled on and off depending on the demand for additional refrigeration of the air circulated through the individual air handling units.

It should be understood that the system depicted in FIG. 4 could utilize multiple central chill water systems each dedicated to one or more units of a multi-unit building, each of which building units might include one or more air handling units. It should thus be understood that a variety of approaches can be taken to providing multiple chill water circuits in order to provide distributed capacity for mechanical refrigeration throughout the entire multi-unit building. The embodiment of FIG. 1 provides greater operating flexibility and overall energy efficiency. However, under certain circumstances, the system approach shown in FIG. 4 might be preferred if, for example, as part of the heat exchanger arrangement 82 a nighttime ice making approach were utilized. This may be advantageous in regions where the relative time of day for energy usage is metered as well as the amount and cheaper energy is available in nighttime hours. Under these circumstances, high energy efficiency and overall lower operating costs may be achieved by making ice in a central chill system during nighttime hours and utilizing the cooling capacity of the ice to provide a chill water to second water coil arrangements as demand for additional cooling is sensed in each individual air handling unit.

Figure 5:
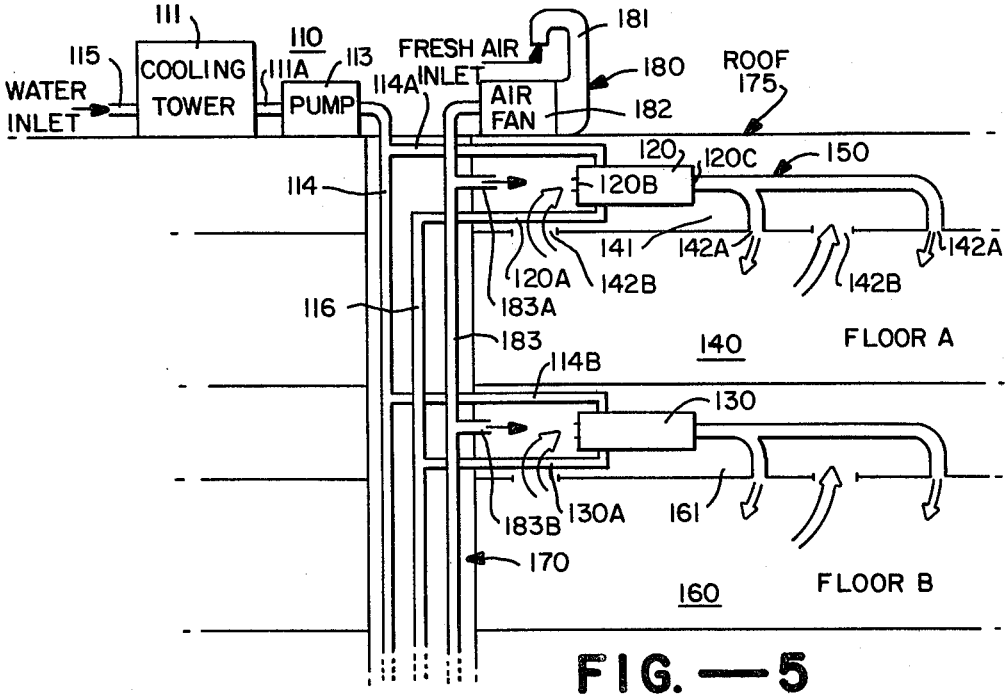
FIG. 5 is a schematic view of an overall system implementation of an air conditioning system in accordance with this invention.

FIG. 5 illustrates in a general schematic way one approach to implementing this invention in a multi-unit building. Only the top two floors, 140 and 160 of the multi-unit building, are shown for purposes of illustration. In this embodiment a cool water source arrangement 110 is provided on the roof 175 of the building and includes a cooling tower 111, a pump 113 and a main cool water pipe 114 which extends through a vertical distribution shaft 170 traversing the entire height of the building. Cooling tower 111 may be any standard cooling tower system, including a temperature control system (not shown) for controlling the amount of cooling of water from a water inlet 115. Pump 113 withdraws cool water from the outlet 111A of cooling tower 111 and pumps it throughout the main cool water pipe 114. Individual inlet pipes 114A and 114B communicate cool water into individual refrigeration units 120 and 130 mounted in the ceiling areas 141 and 161 of building units 140 and 160.

For purposes of illustration, it will be assumed that the refrigeration units 120 and 130 are of the type shown in FIG. 1. Accordingly, cool water communicated to refrigeration unit 120 through the inlet pipe 114A passes through a water coil and refrigeration condensing heat exchanger within the unit 120 and then passes through outlet pipe 120A to a cool water return pipe 116 which extends throughout the height of the vertical shaft 170 of the building. If the embodiment shown in FIG. 4 were employed the cooled water entering the unit 120 would only pass through a first water coil within unit 120 and then enter the outlet pipe 120A to be collected in a common cool water pipe 116 leading to a refrigerant condensing heat exchanger in a central chill water plant.

The entire ceiling area 141 of floor 140 may serve as a return air plenum for the refrigeration unit 120 with air entering this common return through a plurality of ceiling vents 142B. This common ceiling return communicates with the air inlet 120B of the air conditioning unit 120. At the outlet 120C of the air conditioning unit 120, a closed air ducting system 150 communicates the conditioned air to a plurality of air distribution registers 142A.

To provide the required amount of fresh air to circulate through each unit of the multi-unit building, a common fresh air system 180 may be provided. This common fresh air system 180 may, for example, include a fresh air inlet 181 mounted on the roof 175 along with an air fan 182 which pumps air from the fresh air inlet 181 through a common fresh air distribution duct 183. Individual inlet ducts 183A and 183B associated with each floor of the building unit communicate a portion of the fresh air flowing through common duct 183 into the common return ceiling areas 141 and 161 associated, respectively, with the floors 140 and 160. If desired, a heating element may be provided in this central fresh air system to heat the outside air under very low ambient outside air temperature conditions during those periods when the building requires heating rather than cooling.

It should be apparent from the above description that the system and method of this invention has several important advantages over prior art approaches to providing air cooling in multi-unit buildings. In an actual commercial installation of the embodiment of the invention depicted in FIG. 1, the air cooling available from the cool water source arrangement itself was sufficient to carry the heat load of the building on days when the outside ambient temperature was 60°–65° F. and the wet bulb temperature was low (i.e. low outside ambient humidity). On such days when no mechanical refrigeration is required, the only energy consumed by the air conditioning system is the energy required to operate the cooling tower, pump and the energy consumed by the fans in the air handling unit within each air conditioning unit, together with the small amount of energy required for blowing fresh air into each building unit.

This represents a very substantial savings of electrical energy over air side economizer systems which require the use of much larger, high energy consuming fans to pull in outside air and distribute it to various units of the building. Based on actual operating experience in a commercial installation of an air conditioning system in accordance with the embodiment of this invention shown in FIG. 1 in a 33 story commercial building in Seattle, Wash,, the actual energy saving achieved over a substantially equivalent air side economizer system has been estimated at about twenty percent. Moreover, the savings in initial installation costs this compared to an equivalent air side economizer system was about twenty-three percent.

While the basic principles of this invention have been described above in connection with various embodiments, it should be understood that numerous modifications could be made by those skilled in the art without departing from the scope of this invention as claimed in the following claims.

What is claimed is:

1. The method of conditioning air in a multi-unit building comprising disposing at least one air handling unit in each building unit with at least one water coil and one mechanical refrigerant cooled second heat absorbing means arranged in series in said air handling unit, separately circulating air in heat exchange relation with said water coil and said second heat absorbing means in each said air handling unit, circulating cooling water through said water coil in each air handling unit to provide primary cooling of air circulating therethrough independent of the operating condition of said second heat absorbing means, circulating mechanically refrigerated cooling fluid through said second heat absorbing means in each air handling unit when demand for refrigeration of air passing therethrough exceeds the cooling capacity of said cooling water traversing said water coil therein, and utilizing at least a portion of the cooling water exiting said water coil in each air handling unit to at least partially condense vaporized refrigerant associated with producing said mechanically refrigerated cooling fluid.

2. The method of claim 1, wherein each of said second heat absorbing means is a refrigerant evaporator and has a refrigerant condensing heat exchanger and refrigerant compressor directly in circuit therewith to supply condensed refrigerant as said mechanically refrigated cooling fluid, and said cooling water exiting said water coil in each air handling unit is routed through the refrigerant condensing heat exchanger associated with the refrigerant evaporator in said air handling unit.

3. The method of claim 2, wherein each of said second heat absorbing means is a second water coil, said mechanically refrigerated cooling fluid circulating through each said water coil is provided by a central chill water plant including a refrigerant evaporating heat exchanger and a refrigerant condensing heat exchanger, and said cooling water exiting the first water coil in each air handling unit is circulated through said refrigerant condensing heat exchanger in said central chill water plant.

4. The method of claim 1, further comprising deriving cooling water from a central source and supplying the cooling water in parallel to said water coils in said air handling units, and controlling one or both of the temperature and flow rate of said cooling water supplied to said water coils.

5. The method of claim 2, wherein the temperature of cooling water from said central source is controlled and further comprising disposing a cooling water bypass channel around each of said water coils and separately controlling the flow rate of cooling water passing through each water coil and associated diverting channel based on one or both of the demand for refrigeration of the air and the capability of the cooling water to provide refrigeration of the air.

6. The method of any of claims 2 or 3, wherein said cooling water exiting said water coil is supplied to a refrigerant condensing heat exchanger to condense said vaporized refrigerant, and further comprising disposing a cooling water bypass channel around said refrigerant condenser, and separately controlling the rate of cooling water passing through said refrigerant condenser and said associated bypass channel.

7. The method of claim 1, further comprising deriving fresh air from a central source and supplying the fresh air to air handling units in each building unit.

8. In an air conditioning system for use in a multi-unit building, at least one air handling unit in each building unit comprising a water cooled first heat absorbing means, a mechanical refrigerant cooled second heat absorbing means and means for circulating air successively through said first and second heat absorbing means; a refrigerant compressor and a refrigerant condensing heat exchanger operatively associated with said second heat absorbing means; and means for circulating cooling water successively through said first heat absorbing means and said heat exchanger in series relation with a flow rate through at least said first heat absorbing means substantially independent of the operating condition of said refrigerant compressor and said heat exchanger; said second heat absorbing means in each said air handling unit comprising at least one refrigerant evaporator directly coupled with said refrigerant compressor and said refrigerant condensing heat exchanger; said system further comprising first control means for controlling the cooling capacity of cooling water provided to said first heat absorbing means substantially independent of the operation to said refrigerant compressor and said refrigerant evaporator to provide primary cooling of air flowing through each of said air handling units, and second control means individually associated with each of said building units for separately controlling the operation of said refrigerant compressor and said refrigerant condensing heat exchanger associated with air handling units within said building unit to provide supplemental cooling of said air flowing through each said air handling unit as required within said associated building unit.

9. The system of claim 8, further comprising a cooling tower system for supplying cooling water at controlled temperatures in parallel to said first heat absorbing means in each of said air handling units; each of said air handling units further comprising a cooling water bypass circuit means for said first heat absorbing means, including valve means for controlling the flow rate of cooling water through said first heat absorbing means.

10. The system of claim 8, further comprising a cooling water bypass circuit means for said heat exchanger, including valve means for controlling the flow rate of cooling water through said heat exchanger.

11. The system of claim 8, further comprising a fresh air intake system including a central fresh air intake, air distribution means coupling said fresh air intake to each of said building units, and air pumping means for pumping fresh air from said intake throughout said air distribution means.

* * * * *